US007410557B2

(12) United States Patent
Kitada et al.

(10) Patent No.: US 7,410,557 B2
(45) Date of Patent: Aug. 12, 2008

(54) HYDROGEN ACTIVATING APPARATUS

(75) Inventors: Masayoshi Kitada, Wako (JP); Masahiro Hirota, Wako (JP); Kosuke Niki, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 472 days.

(21) Appl. No.: 10/524,229

(22) PCT Filed: Aug. 7, 2003

(86) PCT No.: PCT/JP03/10065

§ 371 (c)(1),
(2), (4) Date: Feb. 9, 2005

(87) PCT Pub. No.: WO2004/031450

PCT Pub. Date: Apr. 15, 2004

(65) Prior Publication Data

US 2005/0274607 A1 Dec. 15, 2005

(30) Foreign Application Priority Data

Sep. 30, 2002 (JP) ..... 2002-284947

(51) Int. Cl.
*C25B 15/00* (2006.01)
*C25D 17/00* (2006.01)

(52) U.S. Cl. ..... 204/229.4; 204/230.5

(58) Field of Classification Search ..... 208/414; 205/637; 204/229.4, 230.5
See application file for complete search history.

(56) References Cited

U.S. PATENT DOCUMENTS

| | | | | |
|---|---|---|---|---|
| 4,113,601 | A | 9/1978 | Spirig | 204/230 |
| 4,663,004 | A * | 5/1987 | Switzer | 205/103 |
| 4,734,168 | A * | 3/1988 | Bockris et al. | 438/658 |
| 5,840,172 | A | 11/1998 | Zugravu | 205/639 |
| 6,126,794 | A | 10/2000 | Chambers | 204/230.5 |
| 6,419,815 | B1 | 7/2002 | Chambers | 210/635 |
| 6,638,413 | B1 * | 10/2003 | Weinberg et al. | 205/637 |
| 6,800,386 | B1 * | 10/2004 | Wang et al. | 429/13 |

FOREIGN PATENT DOCUMENTS

| | | |
|---|---|---|
| JP | 50-131092 | 10/1975 |
| JP | 51-46581 | 4/1976 |
| JP | 53-104576 | 9/1978 |
| JP | 63-143572 | 9/1988 |
| JP | 9-71886 | 3/1997 |
| JP | 11-12773 | 1/1999 |
| JP | 11-77049 | 3/1999 |
| JP | 2000-160383 | 6/2000 |
| JP | 2000-510531 | 8/2000 |
| JP | 2001-286866 | 10/2001 |
| WO | 98/42893 | 10/1998 |

* cited by examiner

*Primary Examiner*—Alexa D. Neckel
*Assistant Examiner*—Zulmariam Mendez
(74) *Attorney, Agent, or Firm*—Hamre, Schumann, Mueller & Larson P.C.

(57) ABSTRACT

At least a pair of electrodes comprising semiconductors or a semiconductor compounds are arranged to be submerged in water or a liquid of a hydrogen-containing organic compound. Applying pulse electric power between the at least one pair of the electrodes activates hydrogen atoms contained in the water or the hydrogen-containing organic compound to produce hydrogen gas. The hydrogen activating apparatus thus constructed eliminates the necessity of doping electrolysis or the like for improving an electric conductivity of the water and allows production of hydrogen from materials containing hydrogen atoms such as water and the hydrogen-containing compound or the like with a low energy.

6 Claims, 3 Drawing Sheets

(a)

| TIME(h) | 0 | 0. 5 | 1. 5 | 3. 0 | 5. 0 | 6. 0 |
|---|---|---|---|---|---|---|
| $H_2$(ml) | 0 | 6. 38 | 18. 70 | 36. 60 | 53. 04 | 63. 51 |
| $O_2$(ml) | 0 | 0. 54 | 1. 45 | 2. 79 | 4. 10 | 4. 98 |
| $N_2$(ml) | 0 | 0. 58 | 1. 36 | 2. 12 | 2. 70 | 3. 34 |
| TOTAL(ml) | 0 | 7. 50 | 21. 51 | 41. 51 | 59. 84 | 71. 83 |

MEASURED WITH DIGITAL MULTIMATE (WITH 4.5 V,1.1mA)

(b)

(c)

| TIME(h) | 0 | 0. 5 | 1. 5 | 3. 0 | 5. 0 | 6. 0 |
|---|---|---|---|---|---|---|
| $H_2$(VOL%) | 0 | 85. 07 | 86. 94 | 88. 17 | 88. 64 | 88. 42 |
| $O_2$(VOL%) | 0 | 7. 20 | 6. 74 | 6. 72 | 6. 85 | 6. 93 |
| $N_2$(VOL%) | 0 | 7. 73 | 6. 32 | 5. 11 | 4. 51 | 4. 65 |
| TOTAL (VOL%) | – | 100. 00 | 100. 00 | 100. 00 | 100. 00 | 100. 00 |

(WITH 4.5 V,1.1mA)

HYDROGEN ACTIVATING APPARATUS

TECHNICAL FIELD

The present invention relates generally to a hydrogen activating apparatus and particularly to a hydrogen activating apparatus having a structure for producing hydrogen by applying pulse electric power between at least one pair of electrodes arranged to be immersed in water or a hydrogen-containing organic compound liquid.

BACKGROUND ART

Recently, hydrogen has attracted attention as replicable fuel in place of petroleum from point views of starvation of natural resources such as petroleum and the greenhouse effect due to carbon dioxide.

Today, as such a method of producing hydrogen, 90% of industry-use hydrogen is produced from petroleum or natural gas by a steam reforming method or a partial oxidizing method.

As methods of producing hydrogen other than these methods, methods in which coal is used as crude material (COG method or the producer gasifying method), a method of collecting by-product hydrogen from a common salt electrolyzer, a method of electrolysis of water and the like have conventionally been done.

Furthermore, recently, a thermochemical producing method or a method of producing hydrogen using sunlight have been studied.

As a method of producing hydrogen other than the methods described above, for example, there is a method of producing hydrogen by thermally decomposing water. This method requires a reaction temperature of 1500° C. at the minimum and carrying out a reaction under a high temperature of 4300° C. in order to increase a decomposition rate of water into hydrogen in which an energy consumption is large, which is not practical except that a low cost power source is available.

On the other hand, there is also a possible method in which alkaline-earth metals such as sodium, potassium, and manganese are doped into water and these metals are caused to chemically react with water. However, these metals are relatively expensive, and it is difficult to utilize these chemical reactions because these reactions are severe.

Furthermore, instead of water used in the method of electrolysis of water, electrolysis with hydrocarbon such as methanol can be considered. Hydrocarbon has a relatively low bonding energy between hydrogen and carbon within a molecule, so that voltage differences necessary for these electrolyses are low, but accompanied with generation of by-products such as CO and $CO_2$ as reaction products, which requires a countermeasure for decomposing and removal of these products.

Furthermore, the inventors have promoted a study regarding an active structure capable of producing hydrogen in which hydrogen is freed from hydrogen bonds in water or hydrocarbon without externally applying energy.

As a hydrogen activating apparatus for producing hydrogen, an apparatus and a method disclosed in a U.S. Patent are known (for example, see U.S. Pat. No. 6,126,794 and U.S. Pat. No. 6,419,815). This apparatus is constructed such that at least one pair of electrodes are immerged in water in a container containing the water in such a condition that the electrodes are made close to each other with respect to a distance therebetween, wherein when pulse electric power is applied between the electrodes, orthohydrogen (generating heat of combustion which is larger than that of parahydrogen) is produced, and when pulse electric power is supplied to a coil arranged at an upper part of water in addition of applying the pulse electric power between the electrodes, the parahydrogen is produced.

In this hydrogen activating apparatus, an input power is 12V×300 mA (a low voltage×a high current), and bubbles of oxygen and hydrogen are produced at the middle between the electrode plates though its principle has not been disclosed. In other words, it is described that water can be decomposed.

However, in the case of using the pulse of 12 V with 300 mA, when a current of 300 mA is conducted through the electrode plates, a decomposition action of water occurs due to the current which is similar to that occurs in the electrolysis. In other words, the power consumption becomes large.

Furthermore, when water is subject to electrolysis, to improve the electric conductivity of the solution, generally, electrolyte such as alkali metal (NaOH, KOH, or the like) is doped to increase a current density, so that a running cost regarding medicine is high.

Then, if water is subject to electrolysis without doping electrolyte, with utilizing super pure water as water, an amount of produced hydrogen becomes low and the cost is high. On the other hand, if service water, which is cheap and harmless, is used, it is difficult to efficiently utilize water because the current density at the electrodes cannot be made high.

The present invention is provided to solve the above-described problems and aims to provide a hydrogen activating apparatus which can produce hydrogen from a substance containing hydrogen atoms such as water or hydrogen-containing organic compound with low energy and which requires no dopant of electrolyte or the like into water to improve an electric conductivity.

DISCLOSURE OF THE INVENTION

A hydrogen activating apparatus as an aspect of the present invention is characterized by a structure in which at least one pair of electrodes comprising semiconductor or a semiconductor compound arranged and immerged in water or a liquid of hydrogen-containing organic compound are supplied with pulse electric power therebetween to activate hydrogen atoms contained in said water or the hydrogen-containing organic compound to generate hydrogen gas.

According to the hydrogen activating apparatus having such a structure:

(1) When pulse electric power is applied between at least one pair of electrodes comprising semiconductor or a semiconductor compound and being arranged and immersed in water or a hydrogen-containing organic compound, energy of electromagnetic waves derived from the pulse electric power is absorbed in hydrogen atoms having magnetic poles, which readily activates the hydrogen atoms, so that hydrogen atoms are easily freed from water or hydrogen-containing organic compound to produce hydrogen (molecules).

(2) Further, applying the pulse electric power that does not directly relate to supplying electrons makes it possible to readily activate and decompose hydrogen atoms even from general service water, distilled water, or a hydrogen-containing organic compound without contamination of the environment at a lower energy.

Accordingly, there is provided a hydrogen activating apparatus capable of producing hydrogen from substances containing hydrogen atom such as water or hydrogen-containing organic compound or the like without necessity of doping electrolyte for improving an electric conductivity at a low energy.

Here, the description "the pulse electric power that does not directly relate to supplying electrons" means pulse electric power of (a high voltage)×(a low current) (not zero, but almost no current). Conventionally, methods for obtaining hydrogen by electrolysis of water or hydrogen-containing organic compound requires an operation condition of (a low voltage)×(a high current) because it is necessary to make a current density at the electrodes high. On the other hand, according to the present invention, a semiconductor material which does not easily allow a current to flow therein is used for the electrodes to which the pulse electric power of (a high voltage)×(a low current) is applied for each pair of electrodes.

In the hydrogen activating apparatus mentioned above, it is desirable that the semiconductor or the semiconductor compound forming the electrodes contains at least one of kinds of silicon, germanium, gallium, phosphorescence, arsenide, cadmium, sulfur, and selenium.

The electrodes are constructed with the electrodes made of at least one kind of the elements, which provides the production of hydrogen with a lower energy than that provided by the conventional electrolysis of water. Here, the element herein means an element which does not has a purity of 100%, but contains a small amount of impurity.

Furthermore, it is preferable that the above-described hydrogen activating apparatus is characterized in that a configuration of the electrodes is a plate or a sleeve.

Conventionally, in the electrolysis of water, it was necessary to make the current density at electrodes larger, which required a complicated shape at surface areas of electrodes such as porous plates and metal mesh, which results in a high manufacturing cost. On the other hand, according to the present invention, the electrodes are formed to have a shape of plate or a sleeve, which can simplify the shape of the electrodes because of the low current density. This reduces the manufacturing cost.

Further, it is preferable that the above-described hydrogen activating apparatus is characterized by the structure enabling that the hydrogen activating apparatus is stopped after the pulse electric power is applied between the electrodes for a predetermined interval, then, a material of the electrode of the positive electrode and a material of the electrode of the negative electrode are exchanged with each other, and after that, the pulse electric power is applied again.

The hydrogen activating apparatus constructed as mentioned above can decompose water in such a condition that there is no loss at the electrodes outside the system. More specifically, when the pulse electric power is applied to the electrodes to the electrodes for a predetermined interval, the material of the electrode on the side of the negative electrode is dissolved into the liquid and deposited on the electrode on the side of positive pole (the side of earth). Then, the material of the electrode on the positive polarity side (on the side of earth) is made to be the material of the electrode on the negative polarity side. Thus, the material of the electrode which was first on the negative polarity side is made to be the material of the electrode on the positive polarity side (earth), and then, the pulse electric power is applied between the electrodes again, so that water can be dissolved in the condition that there is no loss outside the system.

BRIEF DESCRIPTION OF DRAWINGS

FIG. 3 (*b*) is a drawing graphing FIG. 3 (*a*). FIG. 3 (*c*) is a drawing in which FIG. 3 (*a*) is modified to indicate a gas composition as time passes.

BEST MODE FOR CARRYING OUT THE INVENTION

Hereinafter, embodiments according to the present invention will be described with reference to FIGS. 1 to 3.

First, a hydrogen activating apparatus according to an embodiment according to the present invention will be described with reference to FIG. 1. Here, in this embodiment, a case that the hydrogen activating apparatus is applied to the production of hydrogen from water will be described.

Figure 1:
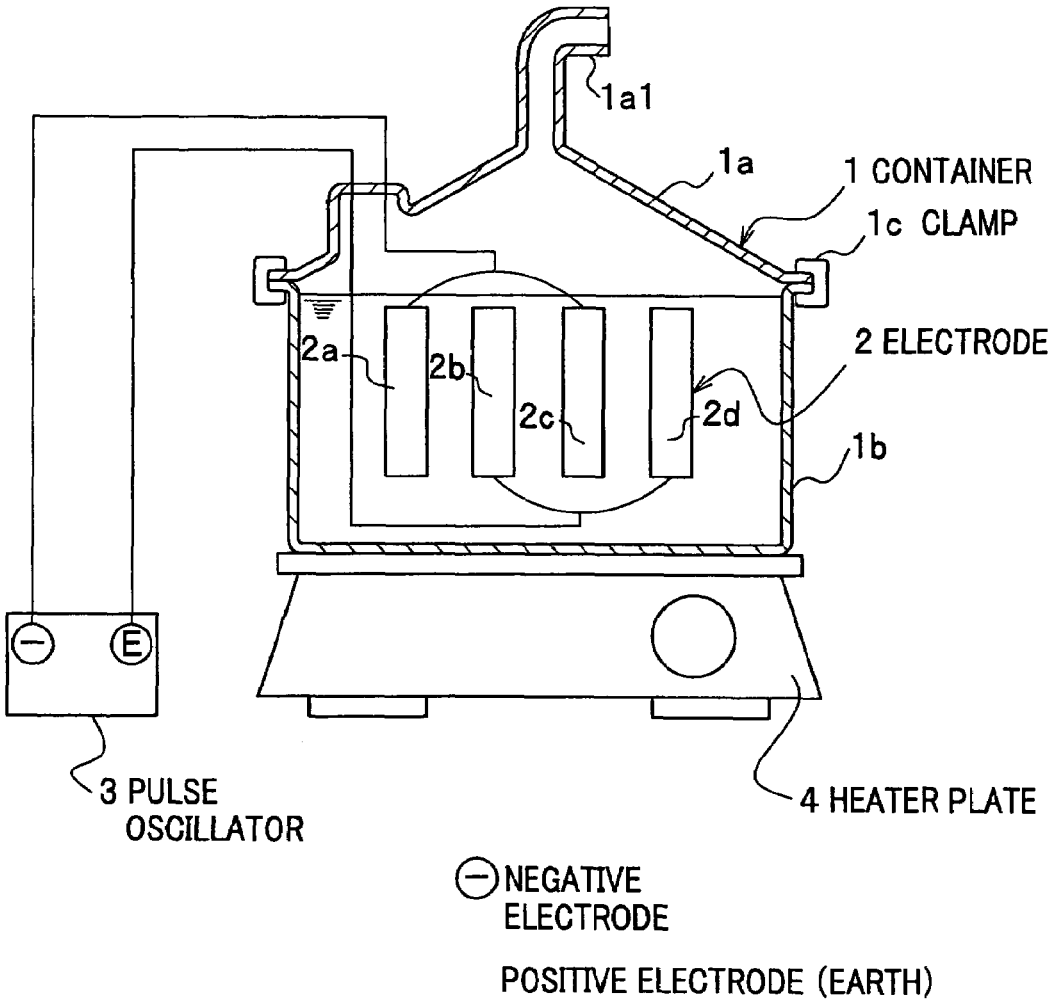
FIG. 1 is a structural drawing illustrating the whole of a hydrogen activating apparatus of an embodiment according to the present invention.

A main part of the hydrogen activating apparatus according to the present invention is constructed, as shown in FIG. 1, with:

- a container 1 filled with a predetermined amount of water;
- electrodes 2 comprising four plates of silicon fixed in a condition that they are immersed in the water;
- a pulse oscillator 3 supplying pulse electric power to the electrodes 2; and
- a heater plate 4 for heating the water in the container 1.

The container 1 is constructed with an upper part 1*a* of the container having a conical shape and a bottom part 1*b* of the container having a sleeve shape.

Further, at the most upper part of the upper part 1*a* of the container having the conical shape, a tube 1*a*1 for introducing a gas produced within the container 1 into equipment collecting the gas by a method of collecting a gas over water at a rear stage (not shown).

Regarding the material of the container 1, glass is used in this embodiment to provide a view of the inside. On the bottom part 1*b* of the container, the upper part 1*a* of the container is placed through an O ring (not shown), and integration is provided by pinching a flange part of the upper part 1*a* of the container and a flange part of the bottom part of the container with a clamp 1*c*.

The electrodes 2 comprise four plates of electrodes 2*a* to 2*d* fixed in a condition that they are immersed in water, each being formed of silicon having a rectangular plate shape with the same dimension.

The electrodes 2 are used such that they are divided into two electrodes 2*a* and 2*c* supplied with a negative voltage from a pulse oscillator 3 mentioned later and two electrodes 2*b* and 2*d* connected to a positive pole (earth).

Further, since the positive pole is connected to the earth, a potential of the positive electrode is always zero volts.

Furthermore, in this embodiment, two pairs of electrodes 2*a* to 2*d* are used. The number of electrodes can be adaptively changed to acquire a necessary amount of hydrogen. The number of electrodes can be changed at a unit of two. Further more, the shape of the electrodes is a rectangular plate. However, sleeve electrodes are also usable.

Conventionally, in the electrolytic method of water, it was necessary to make a current density at electrodes large, which requires forming the surfaces of the electrodes to have a complicated form such as perforated panels and a metal mesh, resulting in a high manufacturing cost of the electrodes. On the other hand, in the present invention, it is enough that the current density is small, which provides simplification of the shape of the electrodes, so that shaping the electrodes into plates reduces the manufacturing cost of the electrodes.

Furthermore, it is preferable that the surfaces of the electrodes are flat to allow the produced gas to be readily freed therefrom. Conventionally, electrodes with grooves, electrodes comprising metal meshes, porous electrodes, electrodes with fins, rolling-shutter electrodes, perforated panel electrodes, which were conventionally used to increase current densities at surfaces of electrodes. However, the surfaces of the electrodes are not flat, which impedes the produced gas upwardly from passing therethrough. This case requires a device for promoting removal of babbles by a forced flow.

In this embodiment, silicon of a semiconductor is used as the material of the electrodes. However, any semiconductor or semiconductor compound can be used which comprises at least one kind of element out of silicon, germanium, gallium, phosphorescence, cadmium, sulfur, and selenium.

Employing silicon of a semiconductor for the material forming the electrodes provides the production of hydrogen with a lower energy than the conventional electrolysis of water with a smaller wear of the electrodes than those made of a conductive material.

The pulse oscillator 3 is provided for supplying the pulse electric power between two pairs of electrodes 2*a* to 2*d*. A pulse electric power generation circuit of the pulse oscillator 3 will be briefly described hereinafter.

The pulse generation circuit of the pulse oscillator 3 that is one of structural elements of the present invention is usually used and known, and, for example, comprises a frequency converting circuit for converting a frequency 50 Hz of a commercial frequency power supply up to 400 Hz, a step-up circuit comprising a transformer supplied with the power having a converted frequency of 400 Hz to provide a high voltage at its output, and a pulse waveform shaping circuit for wave-shaping the stepped-up electric power to a triangular waveform.

The pulse electric power generation circuit of the pulse oscillator 3 constructed as mentioned above first increases the frequency of an AC power supply of 100 V from 50 Hz up to 400 Hz. The reason why the frequency is stepped-up is to miniaturize the transformer in the step-up circuit at the rear stage.

Next, the power having the converted frequency of 400 Hz is applied to a primary of the transformer in the step-up circuit to output a high voltage (for example, 1500 V) at the secondary side.

Further, the stepped-up electric power is applied to the pulse waveform shaping circuit to apply an output signal having the triangular waveform between the electrodes made of silicon arranged and immersed in the water in the container 1.

Regarding a waveform characteristic of pulses of the pulse electric power applied to the electrodes made of silicon will be described with reference FIG. 2.

Figure 2:
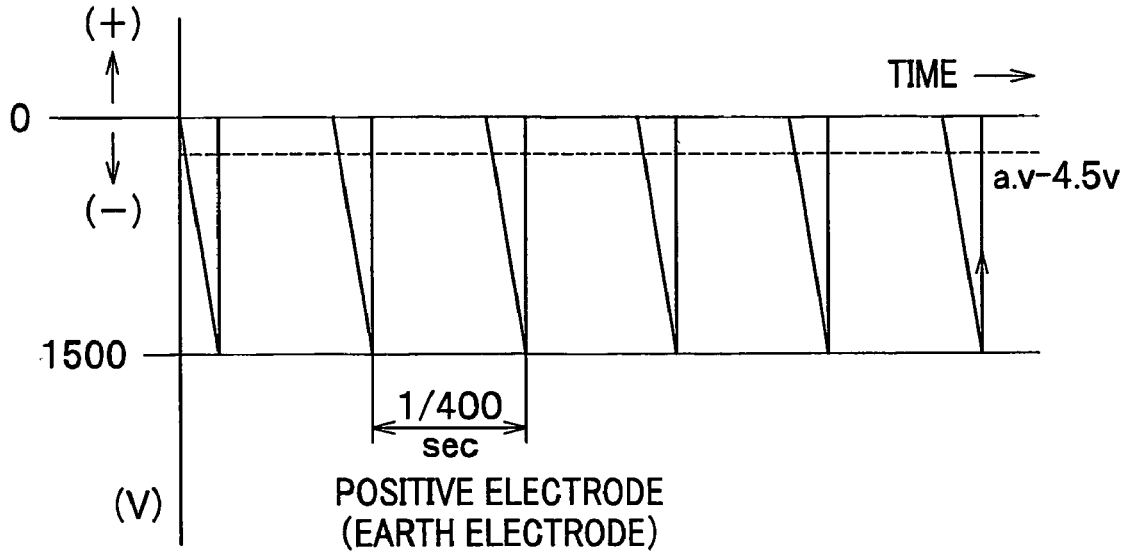
FIG. 2 illustrates a waveform characteristic of a pulse applied between electrodes of the hydrogen activating apparatus of the embodiment according to the present invention.

The waveform characteristic of pulses is as shown in FIG. 2, such that the voltage applied between the electrodes made of silicon is a negative voltage of 1500 V, and the current value is from 1 mA to 5 mA. This is the pulse electric power of (a high voltage)×(a low current).

Further, a waveform of the pulse is a triangle in which an interval of peaks of triangles is 1/400 sec.

The heater plate 4 is an electric heater for heating the water in the container 1 to heat the water in the container up to 95° C. by placing the container 1 containing a predetermined amount of water on the plate from the under side thereof. Heating further activates hydrogen atoms in water by a mutual effect with the pulse electric power applied between the electrodes.

Next, a principle of actuating hydrogen atoms when the pulse electric power is applied to the water between the electrodes was supposed by the inventors and the like.

Hereinafter, this principle will be described.

Around a nucleus of a hydrogen atom (positive electric charge), one electron (a negative charge) revolves with rotation. Thus, Coulomb force, centrifugal force, and the like acts between the nucleus and the electron in which an atomic space in which these pieces of force preserve balance among them.

When the pulse electric power is applied to water between the electrodes made of silicon which is a semiconductor, energy of electromagnetic waves derived from the pulse electric power is absorbed by hydrogen atoms having magnetic poles, so that the hydrogen atoms become in an excited condition.

Thus, the hydrogen atoms and oxygen atoms in water are bonded by hydrogen bond. The inventors considered that the bond between atoms, namely, the hydrogen atom and the oxygen atom, was disconnected due to weakened bond between hydrogen atoms and oxygen atoms, so that hydrogen atoms were freed from the oxygen, which causes bond of hydrogen atoms with each other resulting in hydrogen (molecule).

Next, with reference to FIGS. 1 and 3, an embodiment of decomposition of water with the hydrogen activating apparatus of an embodiment according to the present invention will be described in detail.

1. Structure of Hydrogen Activating Apparatus (a) A container which is transparent and made of glass capable of containing water of 400 mL.

(b) The electrodes which are rectangular and made of silicon, each having dimensions of 20 W×50 L×0.5 t×4 (plates)

(c) The heater plate having a capacity for heating the water in the container from 95° C. to 98° C.

(d) The pulse oscillator with −4.5 V×1.1 mA.

Further, copper wires used as wiring material for connecting the electrodes 2*a* to 2*d* made of silicon to the pulse oscillator 3 are connected by coating with adhesive to prevent reaction between the copper wires and the silicon. The gas produced in the container 1 is collected by a method of collecting a gas over water. The collected gas is analyzed by gas chromatography.

Next, a method of operation when hydrogen is actually produced with this hydrogen activating apparatus will be described.

(1) Fix four electrodes 2*a* to 2*d* made of silicon in the container 1 as shown in FIG. 1.

(2) When the pulse oscillator 3 is connected to four electrodes 2*a* to 2*d* made of silicon, the electrodes 2*a* and 2*c* are connected to a negative electrode of the pulse oscillator 3, and the electrodes 2*b* and 2*d* are connected to the positive electrode (earth) of the pulse oscillator 3.

(3) Next, water is poured in the container 1 until upper ends of four electrodes 2*a* to 2*d* made of silicon are submerged under the surface of water.

(4) The water in the container 1 is heated by placing the container on the heater plate 4 up to 95° C.

(5) Not shown equipment for collecting a gas over water is provided at the rear stage to collect the produced gas of which an amount of the gas is examined.

(6) A power switch of the pulse oscillator 3 is turned on. The pulse electric power is applied to the electrodes 2*a* to 2*d* made of silicon from the pulse oscillator 3 for six hours. When the application of the pulse electric power for six hours has been done, the power switch of the pulse oscillator 3 is turned off.

Figure 3:
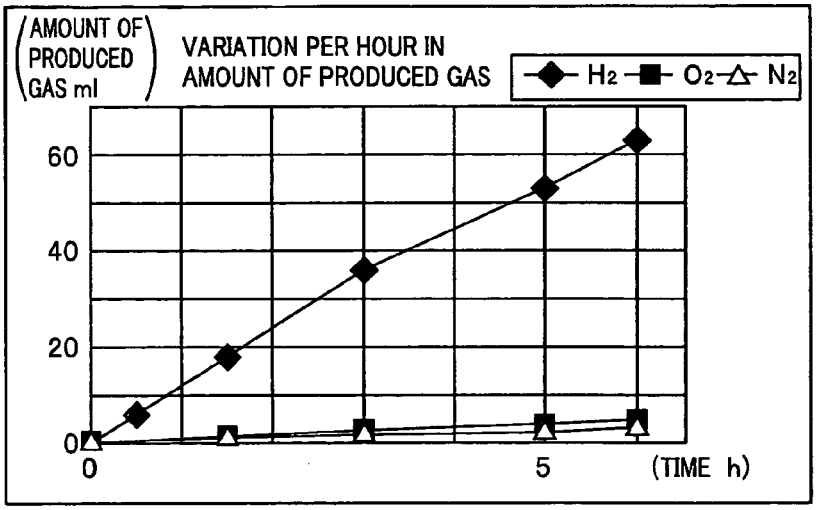
FIG. 3 (*a*) is a drawing illustrating variation as time passes in an amount of the produced gas when the gas is produced from water with the hydrogen activating apparatus according to the present invention.

FIG. 3 (*a*) illustrates variation, as time passes, in an amount of the produced gas when the hydrogen activating apparatus is operated as mentioned above. FIG. 3 (*b*) shows a graphical indication of FIG. 3 (*a*), and FIG. 3 (*c*) shows the variation as time passes in FIG. 3 (*a*) is converted into variation in a gas composition as time passes.

As understood from FIG. 3 (*a*) and FIG. 3 (*b*), application of the pulse electric power to the electrodes made of silicon for six hours from the start of application activates hydrogen atoms in water, so that hydrogen is separated from the oxygen atom as time passes.

Further, amounts of produced nitrogen and oxygen increased as time passed, but were extremely lower than that of hydrogen. In other words, it was understood that hydrogen atoms were selectively activated.

Furthermore, it was seen that hydrogen was produced at the negative electrode side and that silicon was deposited at the side of the positive electrode (earth side). However, when, for example, a consumed amount of silicon of the electrode is large (for example, 10%), the exchanging the materials of electrodes of the positive and negative electrodes with each other enabled the decomposition of the water without loss of silicon in the system outside the system.

Further, in the case that water was decomposed without exchanging the materials of electrodes between the positive and negative electrodes, the production of hydrogen was unable to be observed after about 30 hours. On the other hand, when the water was decomposed with exchange of the materials of electrodes between the positive and negative electrodes, the production of hydrogen was able to be observed after about 100 hours.

The presence and the absence of the deposition of silicon at the positive electrode (earth) was confirmed by observing sample chips of the positive electrodes (earth) after a predetermined time interval elapsed after the start of application of the pulse electric power with a scanning electron microscope (SEM) with X ray micro-analyzer.

According to the hydrogen activating apparatus of an embodiment having such a structure and effect, the use of silicon which is a semiconductor for the electrodes and the application of the pulse electric power obtained by (a high voltage)×(a low current), which is different from the conventional art, provides the followings:

(1) By not electrolysis of water, hydrogen was able to be preferably produced with low energy by selectively activating only hydrogen atoms.

(2) The application of the pulse electric power provided by (a high voltage)×(a low current) produces deposition of silicon at the positive electrode (earth side). However, after a predetermined time interval had elapsed, loss of silicon outside the system was prevented by making the material of positive electrode be the material of negative electrode and making the material of the negative electrode be a positive electrode was able to prevent loss of silicon outside the system.

As mentioned above, the hydrogen activating apparatus of an embodiment has been described. The hydrogen activating apparatus according to the present invention is not limited to this, but can be provided with occasional modification without departing from the technical scope of the present invention.

For example, the pulse electric power generated by the pulse oscillator may have any waveform other than the triangle form as long as the pulse electric power is provided with (a negative high voltage×a low current).

A method of preventing the loss of silicon outside the system may be provided by exchanging the polarities of electrodes with an electronic circuit without exchanging the materials of the positive electrodes (earth) and the negative electrodes.

According to the present invention with the structure and operation as above described, there is provided a hydrogen activating apparatus capable of producing hydrogen from materials containing hydrogen atoms such as water, hydrogen-containing organic compounds, or the like with a low energy without necessity of doping electrolyte or the like for improving the electrical conductivity.

INDUSTRIAL APPLICABILITY

Hydrogen, which can be produced by the method with high energy efficiency with a simple equipment structure using the hydrogen activating apparatus according to the present invention, is expected to be used in all industrial fields as a fuel, replaceable for fossil fuel, used in fuel cells or the like.

The invention claimed is:

1. A hydrogen activating apparatus comprising:

a container for containing a water or a liquid of hydrogen-containing organic compound;

a first electrode;

a second electrode; and a pulse generator for generating and supplying a pulse electric power having a voltage of higher than or equal to 1500 volts (V) and a current of less than or equal to 5 milliamperes (mA) between the first electrode and the second electrode, comprising:

a positive terminal, and a negative terminal, wherein the first electrode and the second electrode are arranged to be submerged in the water or the liquid of hydrogen-containing organic compound, wherein the first electrode and the second electrode include a semiconductors or semiconductor compounds, and configured to be exchangeably connected to the positive terminal and the negative terminal, wherein the hydrogen activating apparatus has:

a first state having the first electrode connected to the positive terminal and the second electrode is connected to the negative terminal wherein application of the pulse electric power between the first electrode and the second electrode activates hydrogen atoms contained in the water or the liquid to produce hydrogen gas, and a second state having the first electrode connected to the negative terminal and the second electrode is connected to the positive terminal, wherein application of the pulse electric power between the first electrode and the second electrode activates hydrogen atoms contained in the water or the liquid to produce hydrogen gas.

2. The hydrogen activating apparatus according to claim 1, further comprising a heating device for heating the water or the liquid of hydrogen-containing organic compound.

3. The hydrogen activating apparatus according to claim 1, wherein the semiconductor forming the electrodes comprises at least one element selected from a group consisting of silicon, germanium, gallium, phosphorus, arsenic, cadmium, sulfur, and selenium.

4. The hydrogen activating apparatus according to claim 1, wherein the semiconductor compound forming the electrodes, comprises at least one element selected from a group consisting of silicon, germanium, gallium, phosphorus, arsenic, cadmium, sulfur, and selenium.

5. The hydrogen activating apparatus according to claim 1, wherein shapes of the first and second electrodes are configured to be plates.

6. The hydrogen activating apparatus according to claim 1, wherein shape of the first electrode is configured to be a sleeve.

* * * * *